US005928036A

United States Patent [19]

Thrush

[11] Patent Number: 5,928,036

[45] Date of Patent: Jul. 27, 1999

[54] DUAL ROW MEMORY CARD CONNECTOR

[75] Inventor: Roger Lee Thrush, Clemmons, N.C.

[73] Assignee: The Whitaker Corporation, Wilmington, Del.

[21] Appl. No.: 08/960,649

[22] Filed: Oct. 30, 1997

[51] Int. Cl.[6] ..... H01R 23/70

[52] U.S. Cl. ..... 439/631

[58] Field of Search ..... 439/631, 60, 61

[56] References Cited

U.S. PATENT DOCUMENTS 3,399,372 8/1968 Uberbacher ..... 439/60
4,220,382 9/1980 Ritchie et al. ..... 439/61
5,277,621 1/1994 Seto ..... 439/493
5,641,295 6/1997 Koyama ..... 439/326

*Primary Examiner*—Steven L. Stephan
*Assistant Examiner*—Javaid Nasri
*Attorney, Agent, or Firm*—Robert Kapalka

[57] ABSTRACT

An electrical connector for interconnecting first and second memory cards to a mother board includes a housing having a pair of card-receiving slots. The housing carries sets of signal contacts and ground contacts. Each of the ground contacts has a pair of contact arms which extend into respective ones of the slots for electrically connecting with both the first memory card and the second memory card.

10 Claims, 1 Drawing Sheet

DUAL ROW MEMORY CARD CONNECTOR

FIELD OF THE INVENTION

The invention relates to an electrical connector for mounting multiple memory modules on a mother board.

BACKGROUND OF THE INVENTION

Modern electronic systems are often required to accommodate multiple memory modules. Multiple memory modules can be installed in individual sockets on a mother board, but this takes up significant board space. Multi-row electrical connectors that mount multiple memory modules in a compact arrangement are known. However, these connectors have some drawbacks, particularly when considered for use in high speed operating systems.

U.S. Pat. No. 5,641,295 discloses an electrical connector having a pair of card-receiving slots for mounting a pair of memory modules on a mother board. The slots are stacked one above the other and oriented so that modules which are installed in the slots will reside parallel to the mother board in respective upper and lower planes. The slots are horizontally offset so that the lower module can be installed in and removed from its respective slot while the upper module remains in its respective slot. A problem with this connector is that contacts which extend from the upper slot to the mother board are relatively long which results in relatively high electrical inductance for these contacts. As operating speeds of electronic systems are increased, inductance becomes a significant problem. Further, this connector has a discrete contact associated with each input/output pad on each of the modules. This results in a very dense arrangement of contacts in the connector and a dense arrangement of leads extending from the connector for attachment to the mother board. There is a need to reduce the number of contacts in a multi-module electrical connector, and to reduce the inductance of the contacts in such a connector.

SUMMARY OF THE INVENTION

The invention is an electrical connector for interconnecting first and second memory cards to a mother board. The connector comprises a dielectric housing having first and second slots which are configured for receiving the first and second memory cards, respectively. A plurality of first signal contacts which are mounted in the housing extend into the first slot for electrically connecting with the first memory card. A plurality of second signal contacts which are mounted in the housing extend into the second slot for electrically connecting with the second memory card. A plurality of ground contacts are mounted in the housing. Each of the ground contacts extends into both the first slot and the second slot for electrically connecting with both the first memory card and the second memory card.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
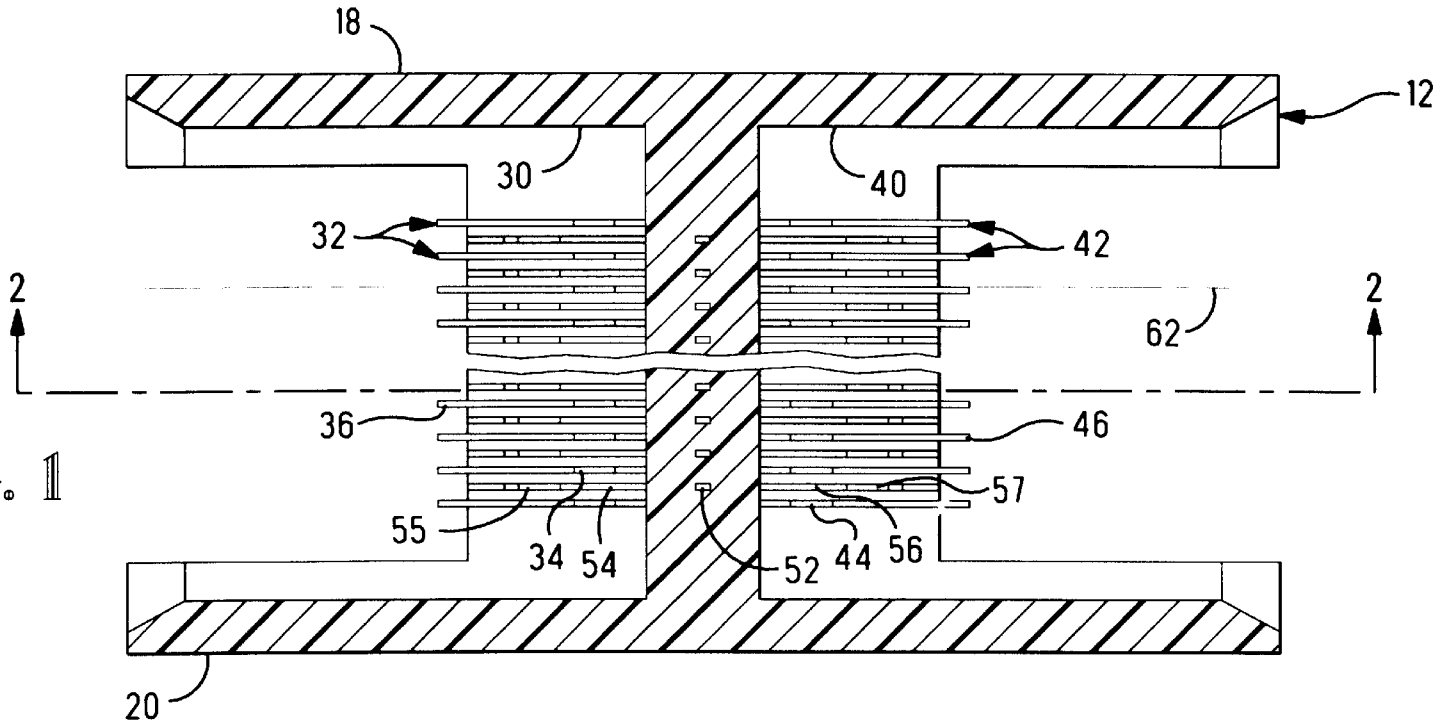
FIG. 1 is a top cross-sectional view of an electrical connector according to the invention.
Figure 2:
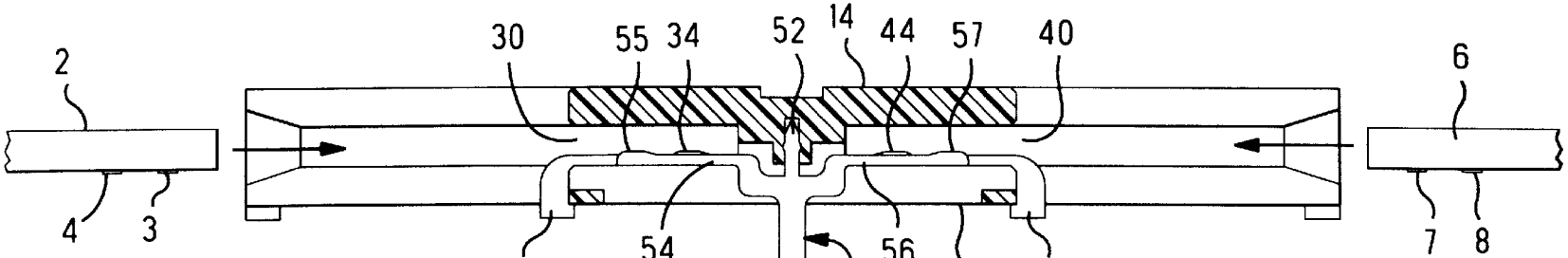
FIG. 2 is a cross-sectional view of the connector taken along line 2—2 of FIG. 1.

There is shown in FIGS. 1 and 2 an electrical connector comprising a dielectric housing 12 having an upper surface

14, a lower surface 16, and opposite end surfaces 18, 20. The connector is adapted to reside on a mother board (not shown) with the lower surface 16 confronting the mother board. The housing has a first slot 30 which is open through one side of the housing and is adapted to receive a first circuit card or memory module 2, and a second slot 40 which is open through an opposite side of the housing and is adapted to receive a second circuit card or memory module 6. The slots 30, 40 are arranged to position the circuit cards 2 and 6 in a common plane extending parallel to the mother board when the circuit cards are disposed in their respective slots.

The housing 12 holds a plurality of first signal contacts 32 and a plurality of second signal contacts 42. Each of the first signal contacts 32 extends into the first slot 30 and has a card-engaging portion 34 which is disposed for engaging a respective contact pad 3 on the first circuit card 2 when the first circuit card is installed in the slot. Similarly, each of the second signal contacts 42 extends into the second slot 40 and has a card-engaging portion 44 which is disposed for engaging a respective contact pad 7 on the second circuit card 6 when the second circuit card is installed in the slot. The first and second signal contacts 32, 42 have respective leads 36, 46 for making electrical connections with corresponding circuit traces on the mother board. As shown, the leads 36, 46 are pads which can be surface mount soldered to the mother board, but it should be understood that the leads may also be formed as pins which are insertable in through-holes in the mother board.

The housing 12 also holds a plurality of ground contacts 50 each of which is secured to the housing by a retention post 52 that is interference fitted in a cavity in the housing. Each of the ground contacts 50 has a first arm 54 which extends into the first slot and a second arm 56 which extends into the second slot. The first arm 54 has an engagement portion 55 which is disposed for engaging a respective ground pad 4 on the first circuit card 2, and the second arm 56 has an engagement portion 57 which is disposed for engaging a respective ground pad 8 on the second circuit card 6. Each of the ground contacts has a single lead 58 which extends below the lower surface 16 of the housing for engaging a ground path on the mother board. Thus, a pair of ground paths on the first and second circuit cards 2, 6 are coupled to a common ground through the single lead 58. This arrangement reduces the number of ground leads which must be connected to the mother board.

As shown in FIG. 1, the first signal contacts 32 are spaced-apart along a length of the first slot 30, and the second signal contacts 42 are spaced-apart along a length of the second slot 40. Pairs of the first and second signal contacts 32, 42 are linearly aligned in respective parallel planes 62. Further, the ground contacts 50 are interleaved between the linear pairs of first and second signal contacts. That is, each linear pair of first and second signal contacts is flanked by a pair of ground contacts, which arrangement serves to isolate adjacent signal contacts so as to reduce electromagnetic interference in high speed signal operations.

As shown in the drawings, the connector housing is configured such that the circuit cards 2, 6 must be installed in their respective slots along linear insertion paths, that is, with a straight-in motion. It should be understood, however, that an electrical connector according to the invention may be constructed to receive circuit cards along paths which are initially linear and then pivoting into final position, that is, with a cam-in motion as is well known in the art.

The invention provides an electrical connector for mounting a pair of memory modules on a mother board. The connector has a low profile which enables contacts used in the connector to be short, thereby providing the contacts with low inductance. The connector has ground contacts which are common to the pair of memory modules, reducing the number of discrete contacts in the connector, and reducing the density of leads which must be attached to the mother board.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector for interconnecting first and second memory cards to a mother board, the connector comprising:

a dielectric housing having first and second slots which are configured for receiving the first and second memory cards, respectively;

a plurality of first signal contacts mounted in the housing and extending into the first slot for electrically connecting with the first memory card;

a plurality of second signal contacts mounted in the housing and extending into the second slot for electrically connecting with the second memory card, the second signal contacts being electrically separate from the first signal contacts; and a plurality of ground contacts mounted in the housing, each of the ground contacts extending into both the first slot and the second slot for electrically connecting with both the first memory card and the second memory card.

2. The electrical connector according to claim 1 wherein the first and second slots are arranged to hold the first and second memory cards in a common plane.

3. The electrical connector according to claim 1 wherein pairs of the first and second signal contacts are aligned in respective planes.

4. The electrical connector according to claim 2 wherein the first and second slots are open in mutually opposite directions.

5. The electrical connector according to claim 4 wherein the ground contacts are interleaved between the pairs of first and second signal contacts.

6. An electrical connector for interconnecting first and second memory cards to a mother board, the connector comprising:

a dielectric housing having first and second slots which are configured for receiving the first and second memory cards, respectively;

a plurality of signal contacts mounted in the housing, each of the signal contacts extending into one of the first and second slots for electrically connecting with one of the first and second memory cards the signal contacts which extend into the second slot being electrically separate from the signal contacts which extend into the first slot; and a plurality of ground contacts mounted in the housing, each of the ground contacts extending into both the first slot and the second slot for electrically connecting with both the first memory card and the second memory card.

7. The electrical connector according to claim 6 wherein the first and second slots are arranged to hold the first and second memory cards in a common plane.

8. The electrical connector according to claim 6 wherein pairs of the signal contacts are aligned in respective planes.

9. The electrical connector according to claim 7 wherein the first and second slots are open in mutually opposite directions.

10. The electrical connector according to claim 9 wherein the ground contacts are interleaved between the pairs of signal contacts.

* * * * *